United States Patent [19]

Brenish et al.

[11] Patent Number: 4,682,383

[45] Date of Patent: Jul. 28, 1987

[54] COMBINATION JOINT RAKER AND JOINTER

[76] Inventors: Michael Brenish, 317 Edmund Ave., Paterson, N.J. 07502; Frank Herzig, 64 Douglas Dr., Towaco, N.J. 07082

[21] Appl. No.: 848,579

[22] Filed: Apr. 7, 1986

[51] Int. Cl.[4] ..... E04F 21/17

[52] U.S. Cl. ..... 15/105.5; 15/235.3

[58] Field of Search ..... 15/235.3, 105.5

[56] References Cited

U.S. PATENT DOCUMENTS

| | | | |
|---|---|---|---|
| 1,061,085 | 5/1913 | Kolson | 15/235.3 |
| 1,292,558 | 1/1919 | Ackerson | 15/235.3 |
| 1,511,807 | 10/1924 | Garner et al. | 15/105.5 |
| 1,619,030 | 3/1927 | O'Neal | 15/105.5 X |
| 3,237,235 | 3/1966 | Moody | 15/235.3 |
| 3,662,423 | 5/1972 | Miller | 15/235.3 |
| 4,432,115 | 2/1984 | Fehler | 15/105.5 |

FOREIGN PATENT DOCUMENTS

| | | | |
|---|---|---|---|
| 1194550 | 6/1970 | United Kingdom | 15/235.3 |

OTHER PUBLICATIONS

"Bent Nail Rakes Mortar Deep and Square", *American Builder,* p. 112, Aug. 1965.

*Primary Examiner*—Chris K. Moore

*Attorney, Agent, or Firm*—Siegmar Silber

[57] ABSTRACT

A combination joint rake and jointer tool for raking and smoothing mortar in the joints of brickwork is described herein. The tool is used for removing excess mortar and for smoothing the remaining mortar. The tool has an elongated tool body having a medial portion forming a handle therefor. A sled bar for smoothing the mortar is attached at both ends of the handle. The sled bar has curved end portions extending from the handle and a runner portion therebetween. Further, a rake and carriage assembly attached at one end of the enlongated tool body includes, in turn, a rake and carriage support attached to one end of the elongated tool body; a pair of wheels attached to the support with one of the pair of wheels on each side of the support for supporting the tool body and sled bar means during travel across the face of the brickwork. An adjustable rake is attached to and extends from the support, which rake is adjustable to a predetermined depth in to the joints. Upon application and in a single movement of the tool along the joint between two courses of brick, the combination tool simultaneously rakes the joint with the adjustable rake and smooths the joint with the runner.

12 Claims, 7 Drawing Figures

COMBINATION JOINT RAKER AND JOINTER

BACKGROUND OF THE INVENTION

1. Field of the Invention

This invention relates generally to bricklayers tools. It is well known to bricklayers that, if a neat, smooth face is wished to be made on a brick wall, it requires two separate operations, when working with a conventional trowel, to lay the brick on mortar. While each of these operations require only a moment of time whenever being done, the accumulation of this time is substantial, when considering the same being repeated throughout the bricklayer's entire working day. This is, accordingly, in need of an improvement.

2. Information Disclosure Statement

The following information disclosure statement is made pursuant to 37 CFR Sec. 1.97 to 1.99. This application is a refiling of Ser. No. 06/632,113, filed July 13, 1984, now abandoned. During prosecution of the aforementioned application the following patents were uncovered: G. Br. Pat. No. 1,194,550 to Norman Greengrass, 6/10/70; U.S. Pat. No. 1,061,085 to F. J. Kolson, 5/6/13; U.S. Pat. No. 1,292,558 to F. H. Ackerson, 1/28/19; U.S. Pat. No. 1,680,643 to P. J. Schneider, 8/14/28; U.S. Pat. No. 1,736,077 to W. A. Goff, 11/19/29; U.S. Pat. No. 3,237,225 to W. B. Moody, 3/1/66; U.S. Pat. No. 3,662,423 to L. P. Miller, 5/16/72.

SUMMARY AND OBJECTS OF THE INVENTION

A combination joint rake and jointer tool for raking and smoothing mortar in the joints of brickwork is described herein. The tool is used for removing excess mortar and for smoothing the remaining mortar. The tool has an elongated tool body having a medial portion forming a handle therefor. A sled bar for smoothing the mortar is attached at both ends of the handle. The sled bar has curved end portions extending from the handle and a runner portion therebetween. Further, a rake and carriage assembly attached at one end of the enlongated tool body includes, in turn, a rake and carriage support attached to one end of the elongated tool body; a pair of wheels attached to the support with one of the pair of wheels on each side of the support for supporting the tool body and sled bar means during travel across the face of the brickwork. An adjustable rake is attached to and extends from the support, which rake is adjustable to a predetermined depth in to the joints. Upon application and in a single movement of the tool along the joint between two courses of brick, the combination tool simultaneously rakes the joint with the adjustable rake and smooths the joint with the runner.

It is an object of the present invention to provide a combination joint raker and jointer, which reduces the two separate operations to a single operation, thereby saving time and allowing more brick to be laid in a day.

It is a further object of the invention to provide a combination joint raker and jointer, which makes the work easier to do, while also achieving better results.

A yet further object of the invention is to provide a combination joint raker and jointer which is simple in design, inexpensive to manufacture, rugged in construction, easy to use, and efficient in operation.

These, and other objects, will be readily evident, upon a study of the following specification, and the accompanying drawings.

DESCRIPTION OF PREFERRED EMBODIMENTS

Figure 1:
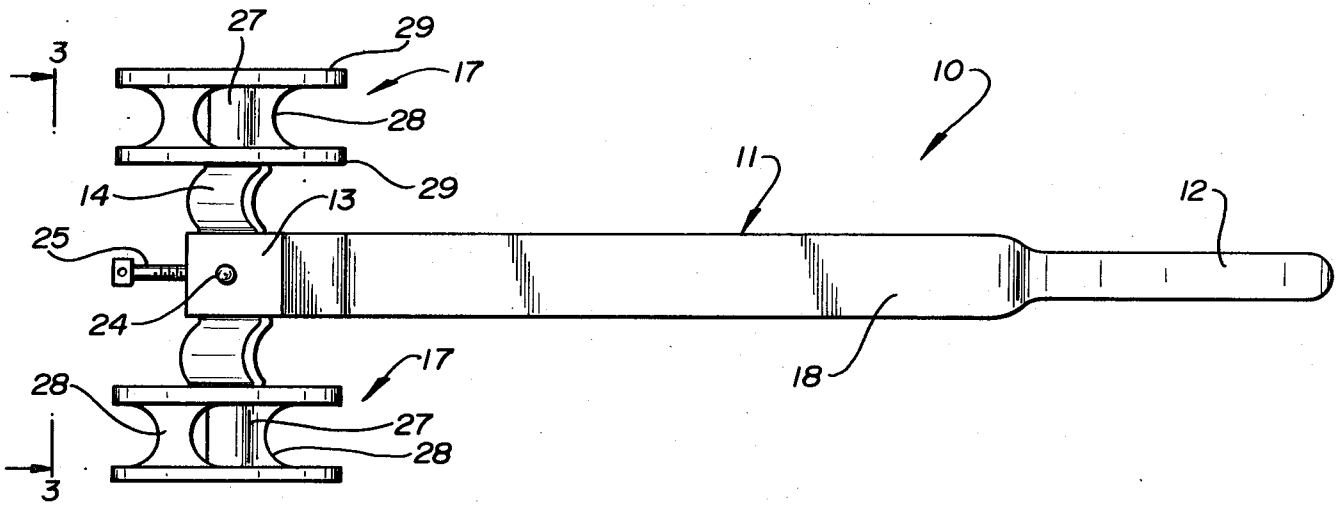
FIG. 1 is a side elevational view of the invention, such as when placed against the side of a brick wall, for cleaning out horizontal mortar grooves.
Figure 2:
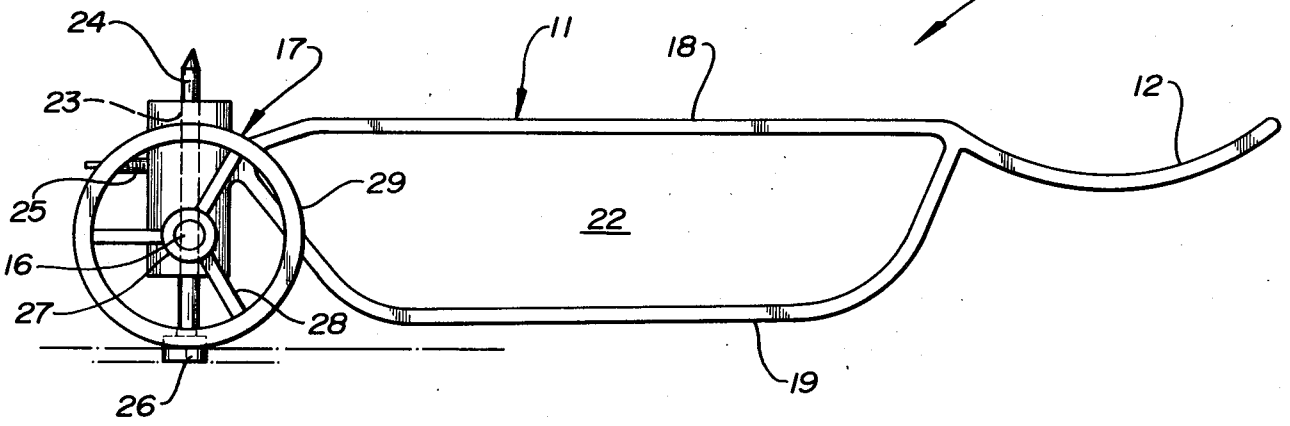
FIG. 2 is a bottom view thereof.
Figure 2A:
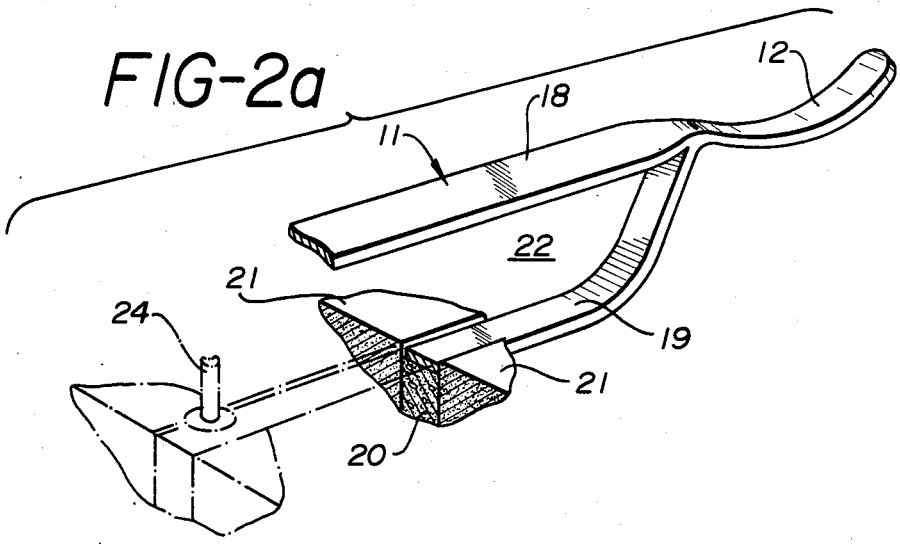
FIG. 2*a* is a fragmentary perspective view thereof, shown in operative use.
Figure 3:
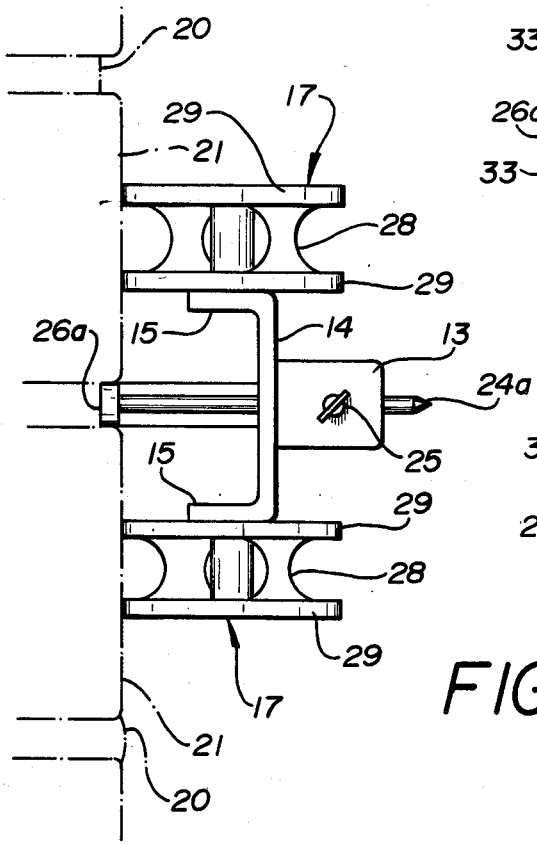
FIG. 3 is a left and elevational view thereof, as viewed on line 3—3 of FIG. 1, and which is shown including a modified design of nail head that is plow-shaped, so as to scoop out the mortar cleanly from the groove.

Referring now to the drawing in greater detail, and more particularly to FIGS. 1 to 3 thereof, at this time, the reference numeral 10 represents a combination joint raker and jointer, according to the present invention, wherein there is a forged metal fram 11, having a curved tail 12 formed at one end, and which, at its other end, is formed with a block 13 and a transverse cross-arm 14, having right angle turned flanges 15 at its ends, in each of which an axle 16 is held, supporting a rotatable wheel 17. The frame includes a straight flat bar running between the tail and the block, for serving as a handle 18, and another "U"-shaped bar, attached to opposite ends of the handle, serves as a sled runner 19, which includes a straight central portion between curved opposite end portions. The runner is made three-sixteenths of an inch thick and five-sixteenths of an inch wide, so as to fit inside a mortar seam 20, that is made between rows of brick 21 in a wall construction. The space 22, between the handle and runner, is approximately one and fifteen-sixteenths inches wide, so that a person's fingers can be comfortably wrapped around the handle. The handle is one-eighth inch thick and three-fourths of an inch wide.

The entire tool is about ten and one-half inches long, and the space between the wheels is about one and eleven-sixteenths inches. It is understood that this invention is not limited to the suggested dimensions.

A hole 23 in the block slidably receives a nail 24, and is adjustably locked therein by a set screw 25. The nail includes a nail head 26, aligned with the runner, and which may be the same diameter as the runner width, so that both may enter the mortar seam 20.

Each wheel comprises a hub 27, connected by only two or three thin spokes 28 to a pair of thin wheel rims 29.

In operative use, the tool rakes the mortar joint with the nail head, and then smooths it out with the runner, all of which is performed in one single operation of moving the tool in either direction, across the face of the brick wall, with the wheels travelling on the brick surface, nd the nail head and runner travelling in the mortar groove at any preferred depth, according to the setting of the nail. It is to be noted, that as the nail head plows out the mortar from a horizontal groove, this mortar falls down through the wheel that is below the nail, and this dropping mortar is prevented from building up on the wheel by means of the thinness of the wheel rims and the spokes, also the minimum number of spokes. Additionally, the side edges of wheel rims and spokes may be made tapered to a very thin edge, so that mortar will still more readily drop off therefrom, because of lack of any broad end edges. The tail 12 serves to touch up vertical joints between the bricks, as well as corners and ends.

Figure 4:
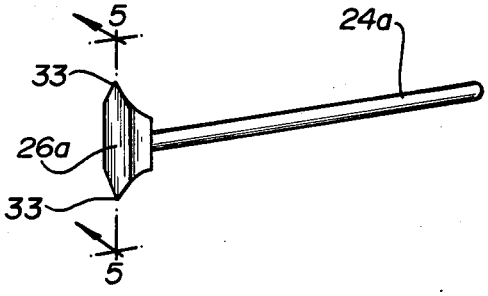
FIG. 4 is a perspective view of the nail used in FIG. 3.
Figure 5:
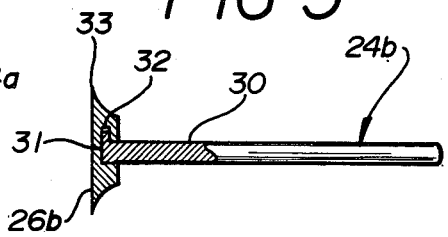
FIG. 5 is a cross-sectional side view, taken on line 5—5 of FIG. 4, and showing a further modified design, wherein the plow-shaped scoop head is a slightly pivotable, for following any groove irregularity.
Figure 6:
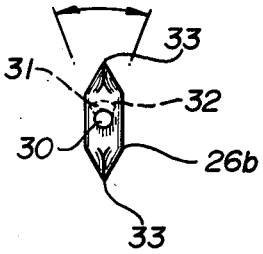
FIG. 6 is an end view thereof.

In a modified design of nail 24*a*, shown in FIGS. 3 and 4, the nail head 26*a* is plow-shaped, so as to scoop outwardly neatly the mortar that is being removed from the groove. In a further modified design of nail 24*b*, shown in FIGS. 5 and 6, the nail consists of a separate nail head 26*b* and a nail shank 30; the nail head being mounted freely pivotable on the nail shank end, for a limited pivotal travel distance, in order to accommodate any irregularity in the mortar groove, such as if the row of bricks are not perfectly aligned with each other. This is accomplished by a narrow spur 31 on the shank pivotable inside of wide, arcuate groove 32 of the nail head. The point 33, at each opposite end of the nail head, permits quicker plowing with neat results.

While various changes may be made in the detail construction, it is understood that such changes will be within the spirit and scope of the present invention, as is defined by the appended claims.

What is claimed is:

1. A combination joint rake and jointer tool for raking and smoothing mortar in the joints of brickwork, said tool for removing excess mortar and for smoothing the remaining mortar comprising:

an elongated tool body having a medial portion forming a handle therefor;

sled bar means for smoothing mortar attached at both ends of said handle, said sled bar means having curved end portions extending from the handle and a runner portion therebetween; and a rake and carriage assembly attached at one end of said elongated tool body comprising, in turn:

a rake and carriage support attached to one end of said elongated tool body;

a pair of wheels attached to said support with one of said pair on each side of the support for supporting the tool body and sled bar means during travel across the face of said brickwork;

an adjustable rake attached to and extending from said support being adjustable to a predetermined depth in said joints; and, attachment means for securing said adjustable rake to said support;

whereby upon application, said tool simultaneously rakes the joint with said adjustable rake and smooths said joint with said runner in a single movement of the tool along the joint between two courses of brick.

2. A combination joint rake and jointer tool as described in claim 1 further comprising:

a tail tip attached to said elongated tool body and curving away from said brickwork when viewed with the tool in use and dimensioned for smoothing mortar between courses of brickwork.

3. A combination joint rake and jointer tool as described in claim 1 wherein said wheels are of double thin-rimmed construction for reducing mortar accumulation on the wheel treads while maintaining the stability of the tool in use.

4. A combination joint rake and jointer tool as described in claim 3 wherein each said wheel has a hub and at least three thin spokes extending from the hub to the rim forming aperture through which excess mortar raked from the brick can pass.

5. A combination joint rake and jointer tool as described in claim 4 wherein each wheel has at least three webs extending between corresponding pairs of spokes for increasing the rigidity of the wheel.

6. A combination joint rake and jointer tool as described in claim 1 wherein said adjustable rake has a body portion for adjustble positioning within said support and a raking foot of a predetermined shape for raking excess mortar from between courses of brickwork.

7. A combination joint rake and jointer tool as described in claim 6 wherein said raking foot is tapered front and back to reduce resistance in plowing through said mortar.

8. A combination joint rake and jointer tool as described in claim 1 wherein said sled bar is dimensioned to fit between adjacent courses of brickwork with the sole of the sled bar of predetermined shape for smoothing mortar.

9. A combination joint rake and jointer tool as described in claim 8 wherein said sole of said sled bar is substantially flat.

10. A combination joint rake and jointer tool for raking the joints in brickwork and for removing excess mortar comprising:

a frame formed with a handle and a sled bar runner extending below and parallel to said frame, said frame at its end opposite said handle being formed with a block;

a pair of spaced-apart wheels supported by said block for supporting the frame for travel across the face of a brick wall, said wheels having a hub and at least three thin spokes that extend from said hub to double rims on each wheel, said spokes permitting excess mortar to pass therethrough, said block being provided with a center bore;

a nail with a head which is adjustable to a needed depth in the mortar joint adjustably carried in said bore; and setscrew means in contact with said nail to provide said adjustment;

whereby, in application, said tool simultaneously rakes the mortar joint with said nail head and smooths said joint with said runner in one single operation of moving the tool in either direction across the face of the brick.

11. A combination joint rake and jointer tool as described in claim 10 wherein said handle being provided with an upwardly extending curved tail tip for use in vertical joints, corners and ends.

12. A combination joint rake and jointer tool for raking the joints in brickwork for removing excess mortar comprising;

a frame formed with a handle and a sled bar runner extending below and parallel to said frame, said frame at its end opposite said handle being formed with a block;

a pair of spaced-apart wheels supported by said block for supporting the frame for travel across the face of a brick wall, said wheels having a hub and at least three thin spokes that extend from said hub to double rims on each wheel, said spokes permitting excess mortar to pass therethrough, said block being provided with a center bore;

a nail with a head which is adjustable to a needed depth in the mortar joint adjustably carried in said bore; and, setscrew means in contact with said nail to provide said adjustment, and said handle being provided with an upwardly extending curved tail tip for use in vertical joints;

whereby, in application, said tool simultaneously rakes the mortar joint with said nail head and smooths out said joint with said runner in one single operation of moving the tool in either direction across the face of the brick.

* * * * *